US005896108A

United States Patent [19]

Shafai

[11] Patent Number: 5,896,108

[45] Date of Patent: Apr. 20, 1999

[54] MICROSTRIP LINE FED MICROSTRIP END-FIRE ANTENNA

[75] Inventor: Lotfollah Shafai, Winnipeg, Canada

[73] Assignee: The University of Manitoba, Winnipeg, Canada

[21] Appl. No.: 08/889,477

[22] Filed: Jul. 8, 1997

[51] Int. Cl.[6] ..... H01Q 1/38; H01Q 21/12

[52] U.S. Cl. ..... 343/700 MS; 343/815; 343/818; 343/795

[58] Field of Search ..... 343/700 MS, 895, 343/792.5, 810, 815, 816, 817, 818, 819, 795; H01Q 1/38, 21/12

[56] References Cited

U.S. PATENT DOCUMENTS

| | | | |
|---|---|---|---|
| 3,984,834 | 10/1976 | Kaloi | 343/700 MS |
| 4,095,227 | 6/1978 | Kaloi | 343/700 MS |
| 4,118,706 | 10/1978 | Kerr | 343/700 MS |
| 4,370,657 | 1/1983 | Kaloi | 343/700 MS |
| 4,740,793 | 4/1988 | Wolfson et al. | 343/700 MS |
| 5,220,335 | 6/1993 | Huang | 343/700 MS |
| 5,712,643 | 1/1998 | Skladany | 343/815 |

*Primary Examiner*—Hoanganh Le
*Assistant Examiner*—Kimnhung Nguyen
*Attorney, Agent, or Firm*—Thomas Adams

[57] ABSTRACT

An end fire microstrip antenna which is particularly suitable for low-profile applications comprises a dielectric substrate having a first surface and an opposite surface. A driven element, a microstrip fedline and a plurality of (parasitic) director elements are provided on the first surface. These elements extend in the same plane and are spaced apart from each other in a longitudinal or end-fire direction of the antenna. Likewise, the director elements are spaced apart from each other in arrow extending in the end-fire direction. The antenna further comprises a ground plane provided on the second surface. The driven element comprises a conductive strip connected at one end to the microstrip feedline and open-circuit at its opposite end. It has at least one undulation in such same plane. The undulation has at least one limb extending transversely to the end-fire direction. A conductive reflector element may be provided behind the driven element. The director elements may comprise dipoles or patches and may be equal in width and uniformly spaced. Alternatively, the width and/or spacing may vary according to the distance from the driven element. A plurality of the antennas may be assembled as an array and operated to provide a single beam or a plurality of individual beams.

28 Claims, 6 Drawing Sheets

MICROSTRIP LINE FED MICROSTRIP END-FIRE ANTENNA

FIELD OF INVENTION

This invention relates to antennas and especially to microstrip antennas.

BACKGROUND

Embodiments of the invention may comprise a single high-gain antenna, or an array of such antennas, fed from a radio frequency source for radiating electromagnetic energy—or connected to a receiver for reception of such energy. In order to embrace both alternatives, in this specification, the term "driven element" will be used for that element of the antenna which, for transmission, would be driven by a signal source to provide radiation but, for reception, would be connected to the receiver.

Microstrip antennas usually are printed on a dielectric substrate, backed by a ground plane, and radiate in the direction normal to the ground plane, with little or no radiation along the ground plane. They offer numerous advantages, including low weight, low profile and ease of fabrication using printed circuit technology. The latter becomes increasingly important at high microwave frequencies, where the signal wavelength is short and maintaining fabrication tolerances is difficult to achieve by other techniques. In addition, microstrip antennas can easily be integrated with electronics, which makes them ideal candidates for applications using integrated electronics. Achieving higher gains is also relatively easy using microstrip antenna technology. Several radiating, driven elements can be printed on the same substrate, to form an array, and fed using conventional microstrip line feed networks. Beam scanning is also possible by placing phase shifts between the array elements. However, the scan range is limited for microstrip arrays.

Because each microstrip antenna radiates normal to its ground plane, the array gain decreases rapidly for angles near the ground plane. In other words, hitherto, microstrip antennas and their arrays have not been capable of high gain radiation parallel to the plane of their arrays. This is a major limitation of microstrip antennas.

The introduction of mobile satellite communications systems, such as MSAT, has resulted in a need for low-profile directional microstrip antenna configurations which can conveniently be conformed to, for example, an aircraft wing or land vehicle roof. U.S. Pat. No. 5,220,335 (Huang) discloses such an antenna having a driven element, a reflector and two directors, all of which are microstrip patch elements and coplanar. According to Huang, (Col. 5, line 16) one embodiment of his invention tilts the antenna beam about 40 degrees from the usual normal direction i.e. perpendicular to the plane of the patches, while a second embodiment provides only 30 degrees of tilting (Col. 5, line 34). Hence, true end-fire radiation is not achieved.

A similar microstrip antenna, but without the reflector element, is disclosed in U.S. Pat. No. 4,370,657 (Kaloi). Thus, Kaloi's antenna has a microstrip patch driven element and two coplanar parasitic director elements. It too does not achieve true end-fire radiation.

An object of the present invention is to overcome the limitation of these known antennas and provide a low-profile microstrip antenna capable of higher gain in the plane of the antenna.

SUMMARY OF THE INVENTION

According to a first aspect of the present invention, an antenna unit comprises a dielectric substrate having a first surface and an opposite surface, and a microstrip antenna with a microstrip feedline provided on said first surface, the antenna comprising a driven element and a plurality of director elements, the driven element and said director elements extending in a common plane and being spaced apart from each other along a longitudinal axis of the antenna, the driven element being configured to have a maximum sensitivity substantially along said longitudinal axis and substantially in said plane, the antenna unit further comprising a ground plane provided on said opposite surface, the ground plane extending beneath the microstrip line but terminating before the driven element.

Preferably the driven element comprises a conductive strip connected at one end to said microstrip feedline and open-circuit at its opposite end and having at least one undulation about said longitudinal axis and in said plane.

In preferred embodiments, the antenna elements and the microstrip feedline are printed on a thin dielectric substrate by a suitable technique such as photo etching, thereby resulting in a compact planar configuration.

The driven element preferably has a physical length per undulation of about one and a half (1.5) times the electrical wavelength. Its exact length per undulation depends on the number of undulations, because of the coupling between the undulations. Although a large number of undulations is feasible, in a preferred embodiment a single undulation is used. A single undulation minimizes the antenna length and also increases its operating bandwidth. With a single undulation, the physical length of the undulation preferably is about 1.43 electrical wavelength.

Where the driven element is fed directly from the microstrip line, the total length of the limb connected to the microstrip line may he increased by a fraction of one undulation.

In a preferred embodiment, the length of the undulation, i.e. between a first position at which the driven element crosses the longitudinal axis to the position at which it next crosses the longitudinal axis in the same direction, is 1.43 wavelengths and the total length of the driven element is 1.87 wavelength.

The plurality of directed elements, for example printed conductive dipoles or patches, in front of the driven element enhance the radiation gain of the antenna. Their electrical lengths are slightly smaller than one half wavelength. Their exact physical sizes depend on their number and locations. Preferably, those immediately in front of the driven element have the largest size and their separation is the smalles. They resonate at the signal frequency and capture and direct its energy in the End-Fire direction. As the distance from the driven element increases, the sizes of the dipoles decrease and their physical separation decreases to gradually release the wave energy into the radiation in the End-Fire direction. Their actual size and the rate of decrease, as well as the rate of increase in their separation, depend upon the number of dipoles. In one preferred embodiment twenty-eight directive dipoles are used, and their initial and final lengths are 0.46 aid 0.37 electrical wavelength. The decrease or taper may be uniform, or may vary. Increasing or decreasing the number of directive elements, in turn, increases or decreases the antenna End-Fire gain.

The reflective element, for example a conductive dipole, behind the driven element is larger than one half wavelength and reflects the driven element wave to the End-Fire direction. This reflective element is positioned over the conductive ground plane of the microstrip line and, together with the directive dipoles in front of the driven element, generates a uni-directional radiation of an End-Fire beam. Its reparation from the drip element is small and in the preferred embodiment is optimized to be about 0.17 wavelength.

The driven element preferably is fed directly from a conventional microstrip line. The microstrip line has a conductive ground plane below the substrate. This ground plane terminates just before the driven element, so that the microstrip line impedance is maintained, and the driven element can radiate efficiently. The conductive ground plane does not extend below the driven element or the directive dipoles. The microstrip line feeds the driven element from a radio frequency source in the transmit mode, or it connects the signal received by the antenna to a receiver in the receive mode. This microstrip line can be designed, using known technology, to generate an appropriate impedance to match the input impedance of the launcher. In a practical design it may include an impedance transformer, or matching stubs, to fulfil the impedance match.

One preferred embodiment, therefore, includes the conductive microstrip feed, the reflecting patch/dipole, the undulated driven element, and the directive dipoles on the top surface of a dielectric substrate. On the bottom surface there is only the conductive ground plane that extends only under the microstrip feed line and the reflecting dipole. The dielectric substrate is preferably a low dielectric constant material but it can be any suitable commercial substrate.

According to a second aspect of the invention there is provided an array of antenna units each according to the first aspect, and circuitry for coupling the antenna units so as to provide for a corresponding plurality of beams, one from each antenna unit.

The antenna units in the array may be arranged in a circle such that respective longitudinal directions of the antenna units extend radially, and the circuitry for operating the antenna units may provide a plurality of switched beams together encompassing the entire circumference of said circle.

According to a third aspect of the invention, there is provided an array of antenna units each according to the first aspect, and circuitry for coupling the antennas to provide a single beam. The antenna units may be arranged in a circle such that respective longitudinal directions of the antenna units extend radially, and the circuitry may operate the antenna units simultaneously to provide a single omni-directional beam. In either of the second and third aspects, the circuitry may be provided within the circle on a common substrate with the antenna units.

BRIEF DESCRIPTION OF THE DRAWINGS

Further objects and features of this invention will become clear from the following description of preferred embodiments, which are described by way of example only and with reference to the accompanying drawings, in which.

DESCRIPTION OF PREFERRED EMBODIMENTS

Figure 1:
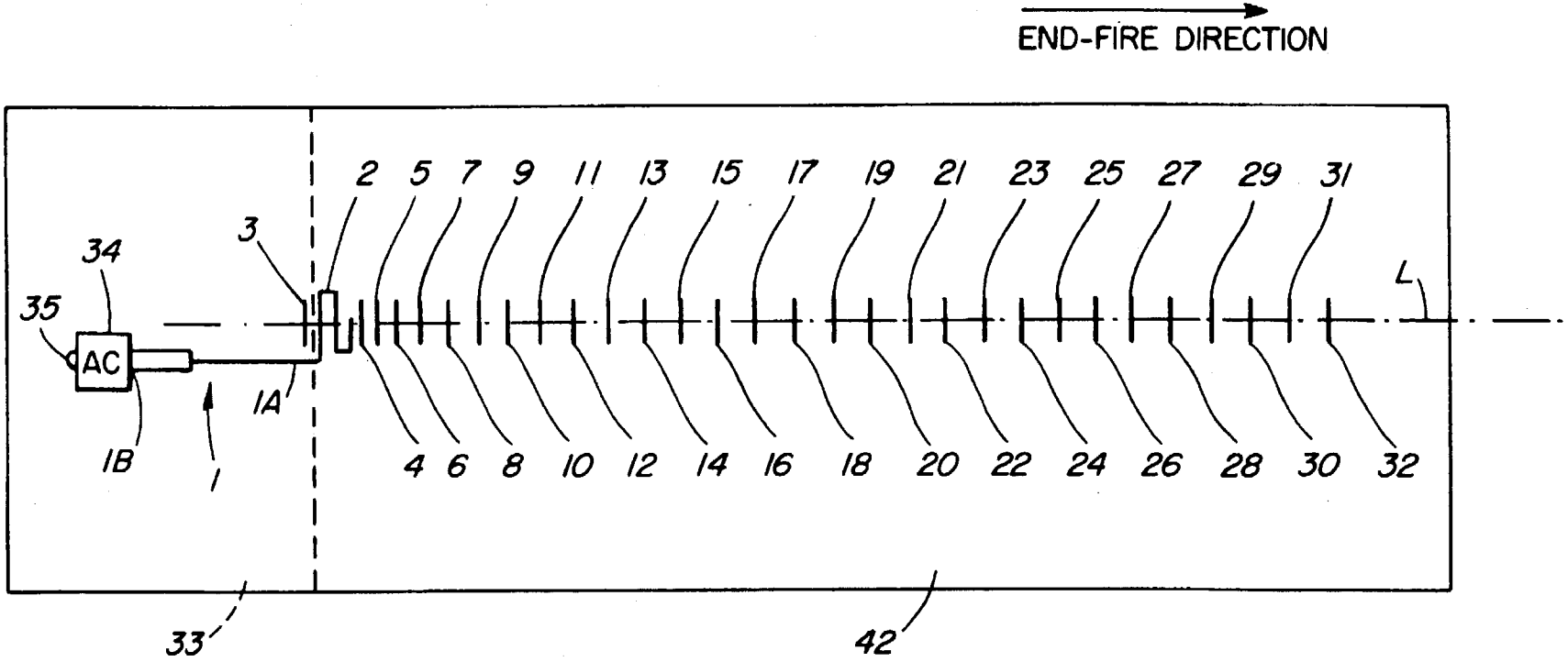
FIG. 1 is a plan view of an antenna showing its various constituents, namely a microstrip line, fed at one end and connected at the opposite end to the undulated wave launcher in the form of a hook, a single dipole behind the launcher, several directive dipoles in front, and a partial ground plane under the microstrip line.

In the drawings, corresponding or identical elements in the different Figures have the same reference numeral.

Figure 2:
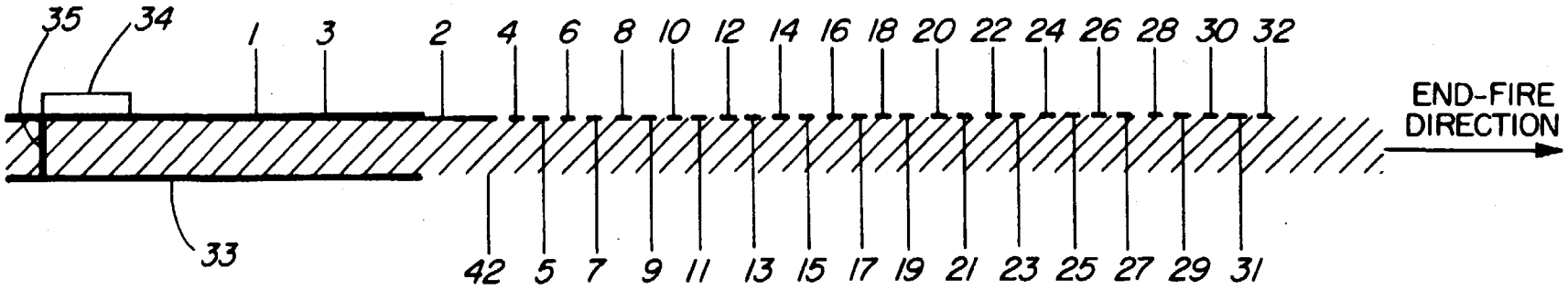
FIG. 2 is an expanded view of the wave launcher.

Referring to FIGS. 1 and 2, an end-fire microstrip antenna unit comprises a microstrip line 1 and an antenna comprising a driven element 2, reflective dipole 3 and directive dipoles 4 to 32. All of these elements are printed on one side of a thin dielectric substrate 42, together with a signal circuit 34 which may be a source or receiver and may be formed as a Monolithic Microwave Integrated Circuit (MMIC) or using another suitable technique. On the opposite side of substrate 42 is printed a conductive ground plane 33.

The ground plane 33 terminates just before the start of the first vertical arm 37 of the wave launcher 2. The thickness of the dielectric influences the electrical coupling of different antenna sections, and preferably is less than 0.2 wavelength to minimize launching of undesirable modes inside the dielectric substrate. Preferably, the relative permittivity er of the dielectric substrate is small, around 2.2 to 10, to make the substrate suitable for both the antenna and integrated microwave circuits for the source/receiver.

The driven element 2 comprises a hook-shaped undulation of m crostrip line. The undulation is rectangular in shape, comprising slightly more than one cycle of a square waveform, and its major limbs extend transversely to a longitudinal ax s L parallel to the end-fire direction of the antenna, indicated by the arrow in FIG. 1.

One end of the wave launcher 2 is connected to radio frequency source 34 by way of conductive microstrip line 1. Its other end is left open circuit, thereby radiating the fed electromagnetic energy into space. The reflective element 3 comprises a conductive dipole 3 which extends transversely to the end-fire direction and "behind" the driven element 2, i.e. on the same side as the microstrip line 1. The length of this reflective dipole 3 is slightly greater than one half wavelength and preferably is about 0.505 wavelength to reflect the radiated energy of the wave launcher 2 towards that end of the antenna remote from the microstrip line 1. The separation of this reflective dipole 3 from the driven element 2 is small and is preferably between 0.1 and 0.2 of a wavelength.

The director elements comprise a series of dipoles 4 to 32, each extending transversely to the longitudinal axis, arranged in a row at the other side of the driven element 2 from the reflective element 3. The electrical length of each of the dipoles 4 to 32 is less than the length of the reflective dipole 2 and depends upon its position in the series. Thus, in the present embodiment, the length of first dipole 4 is slightly smaller than one half wavelength and preferably is 0.46 wavelength. Subsequent dipoles are of progressively shorter length, the last dipole 32 having an electrical length of 0.37 wavelength. The lengths of these dipoles 4 to 32 could all be the same, but a progressive reduction of their lengths, or "tapering" improves the antenna input impedance and radiation pattern. The "tapering" need not be uniform, i.e. the decrease in length between each pair of dipoles need not be the same. Indeed, it is envisaged that the last dipoles 2, and possibly its neighbour 31, might even be longer than the others.

Although the separation between each adjacent pair of directive dipoles 4 to 32 could be kept constant and the same, it has been found that a gradual increase of the separation improves the antenna End-Fire gain. In the present embodiment, the separation of dipoles 4 and 5 is 0.17 wavelength, and increases gradually and becomes 0.39 wavelength for dipoles 31 and 32. The separation of the dipole 4 from the end of the wave launcher 2 is also dependent on the number of dipoles and in the present embodiment is 0.1 wavelength.

Figure 3:
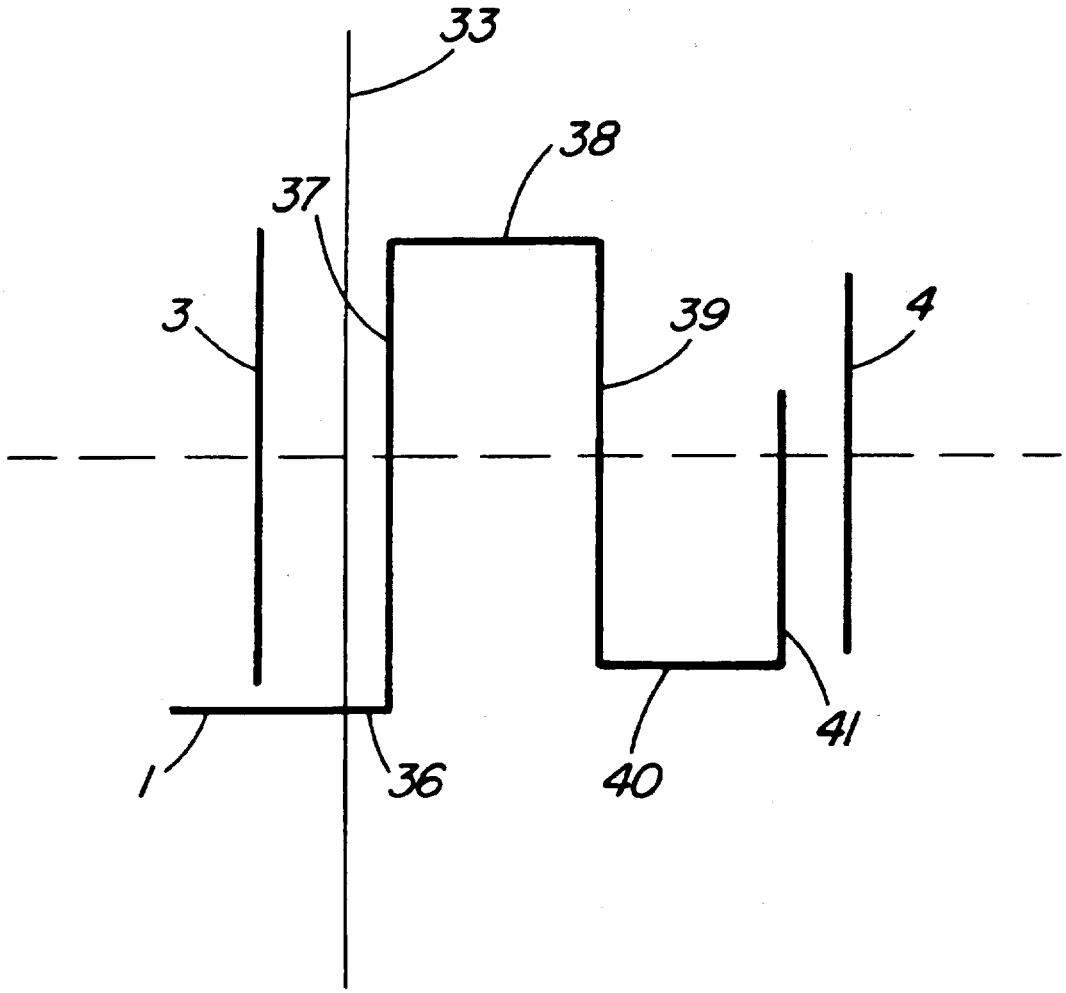
FIG. 3 is a cross-sectional view of the antenna of FIG. 1.

The driven element 2, reflective dipole 3 and first directive dipole 4 are shown in more detail in FIG. 3. For convenience, the following description will refer to the end-fire direction as longitudinal and the direction transverse to the longitudinal but in the plane of the antenna as transverse. The wave launcher 2 comprises three transverse sections or limbs 37, 39 and 40 and three longitudinal sections 36, 38 and 40. The first longitudinal section 36 connects the microstrip line section 1B to the firs transverse limb 37. Longitudinal section 36 is relatively short so as to minimize its radiation but long enough to ensure that the first transverse limb 37 of the wave launcher 2 is clear of the adjacent edge of the ground plane 33 of the microstrip line 1. In this preferred embodiment, longitudinal section 36 is 0.03 wavelength long. The first transverse limb 37 has a length of 0.59 wavelength, slightly greater than the middle or return transverse limb 39, which is equal in length to 0.56 wavelength. In view of this slightly greater length of the first limb 37, its end connected to the microstrip line section 1B is beyond the end of reflective dipole 3, enabling the microstrip line section 1B to clear the reflective dipole 3.

The second longitudinal section 38 interconnects the first and second transverse limbs 37 and 39 and has a length of 0.154 wavelength, as does third longitudinal section 40 connecting the middle transverse limb 39 with the final transverse limb 41. The length of the final transverse limb 41 is optimized for peak antenna gain in the End-Fire direction, and in this preferred embodiment is 0.38 wavelength.

Referring again to FIG. 1, the microstrip line 1 comprises at first, narrower section 1A connected to the wave launcher 2 and a second, wider section 1B which is connected to a radio frequency source 34, indicated as AC. The source 34 is connected to the ground plane 33 by way of a through-hole connection 35 (FIG. 2)). In a reception mode, the source 34 would be replaced by a suitable receiving circuit. The lengths and widths of the microstrip line sections 1A and 1B are selected in accordance with known microwave circuit design rules to match the impedance of the source 34 to the input impedance of the antenna, which is that of the wave launcher 2.

Figure 4:
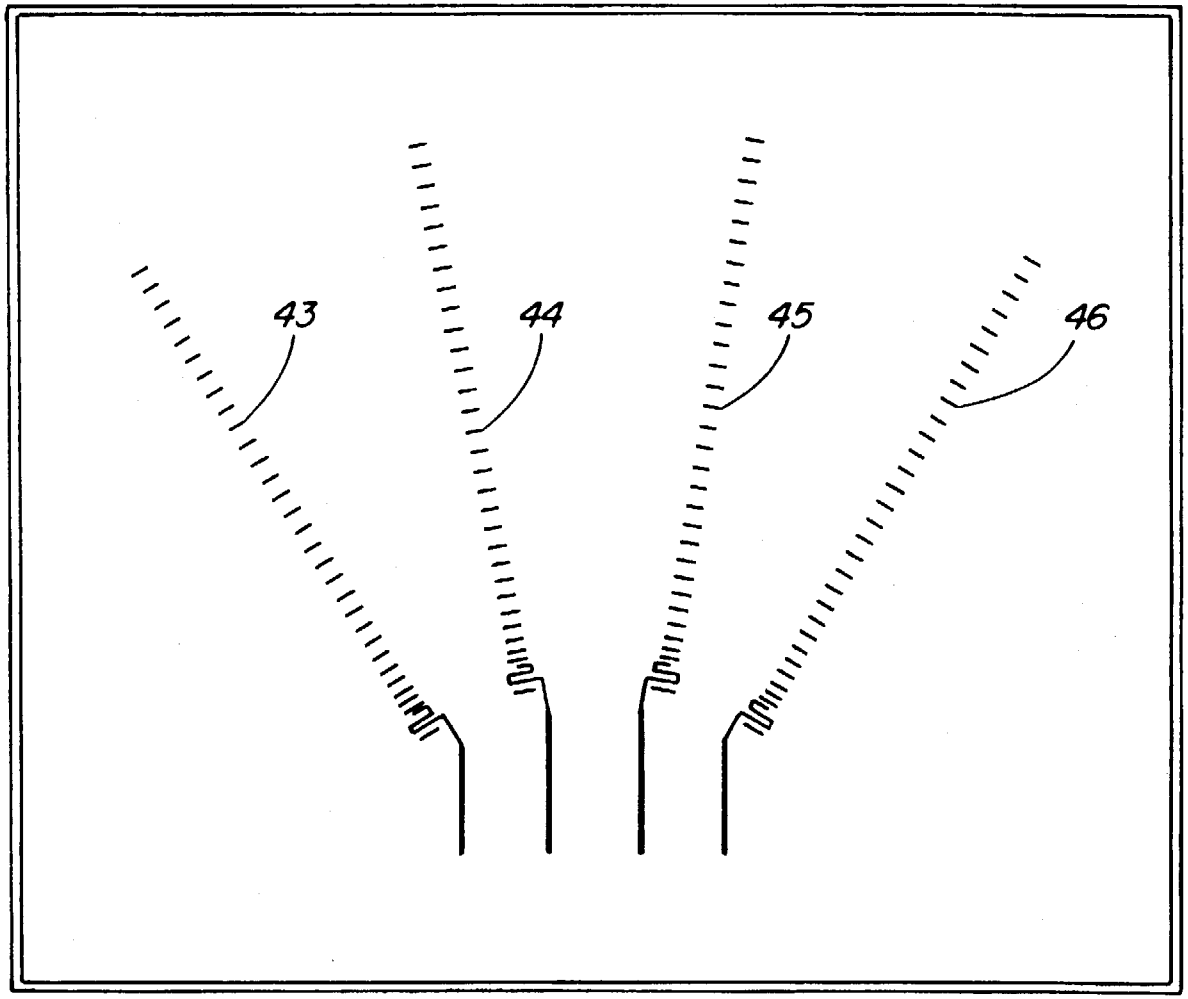
FIG. 4 illustrates four such antennas printed on single dielectric substrate to form an array to generate four separate beams, or one high gain beam, depending on the radio frequency source connected to the feeding microstrip lines.

The presented antenna radiates the electromagnetic energy with high gain, along its End-Fire direction, that is along its length. Its printed configuration facilitates multiple unit designs for different applications. One such design is shown in FIG. 4, with four antennas 43 to 46. They can be fed separately, one at a time to generate four separate radiation beams along each antenna, or they can be fed simultaneously to generate a much higher radiation gain.

In the antenna array embodiment of FIG. 4, the individual antennas 43 to 46 are similar to that shown in FIG. 1, with the exception of the microstrip lines feeding their respective wave launchers which, in this case, use a different design approach to obtain a satisfactory impedance match. Thus, whereas the antenna of FIG. 1 has a narrower microstrip line section 1A and a wider microstrip line section 1B, each of the microstrip lines in FIG. 4 is tapered at its end adjacent the driven element 2 to match the size and input impedance of the associated driven element 2.

Figure 5:
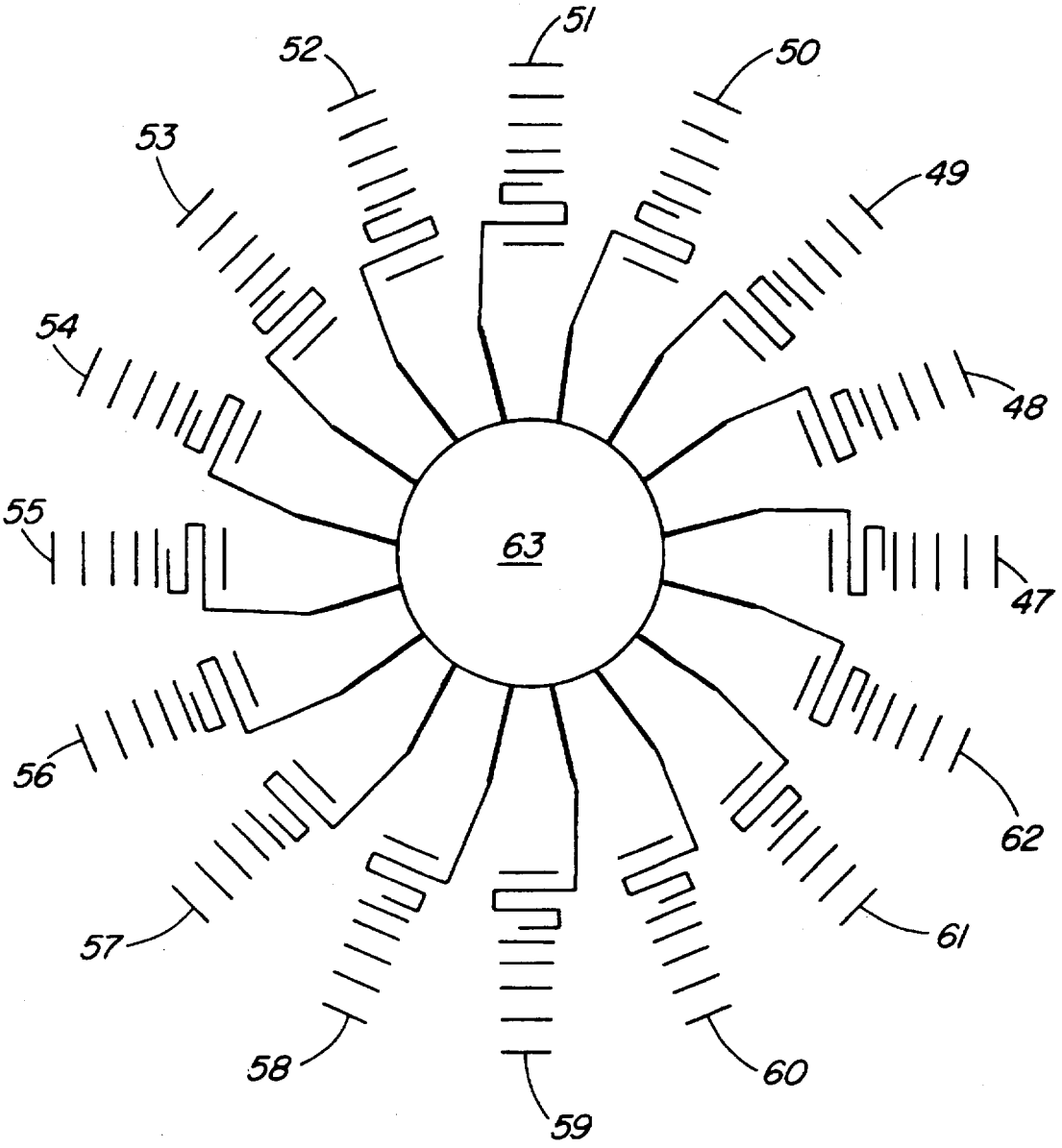
FIG. 5 shows another example of an array antenna formed by sixteen antennas in a sixteen element circular array, to generate sixteen different beams one beam from each antenna, or a single omni-directional beam by simultaneous feeding of all antennas.

Another embodiment of the present invention, shown in FIG. 5, comprises a circular array of 16 antennas 47 to 62. Again, each antenna unit is simular to that shown in FIG. 1 but, for ease of illustration, only five directive elements are shown in FIG. 5. In such an embodiment, when the antennas 47 to 62 are fed by respective ones of a plurality of separate signal sources (not shown), the array generates 16 different beams, angularly separated by 22.5 degrees.

A suitable electronic circuit 63 provided on the substrate 42, in the central circular region, switches and activates each antenna, thereby resulting in a high gain switched beam antenna. The design of such a circuit 63 will be known to a person skilled in this art and so will not be described in detail here. Since each antenna radiates in its own End-Fire direction, the array of FIG. 5 can cover the entire horizontal plane with 16 beams, each covering 22.5 degrees of the space.

Alternatively, all sixteen antennas may be fed simultaneously and in-phase to generate a single omni-directional beam.

It should be noted that, although the above-described embodiments relate to a radiating antenna, the same construction can be used for a reception antenna, simply substituting a receiver for a signal source or transmitter.

Figure 6A:
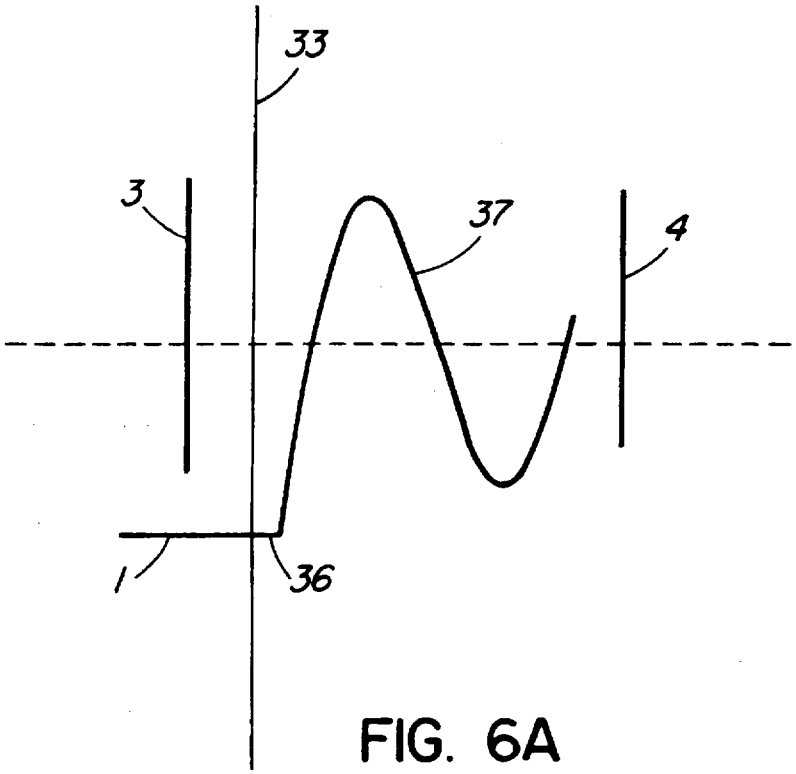
FIGS. 6A and 6B illustrate alternative driven elements having, respectively, sinusoidal and triangular shapes.
Figure 6B:
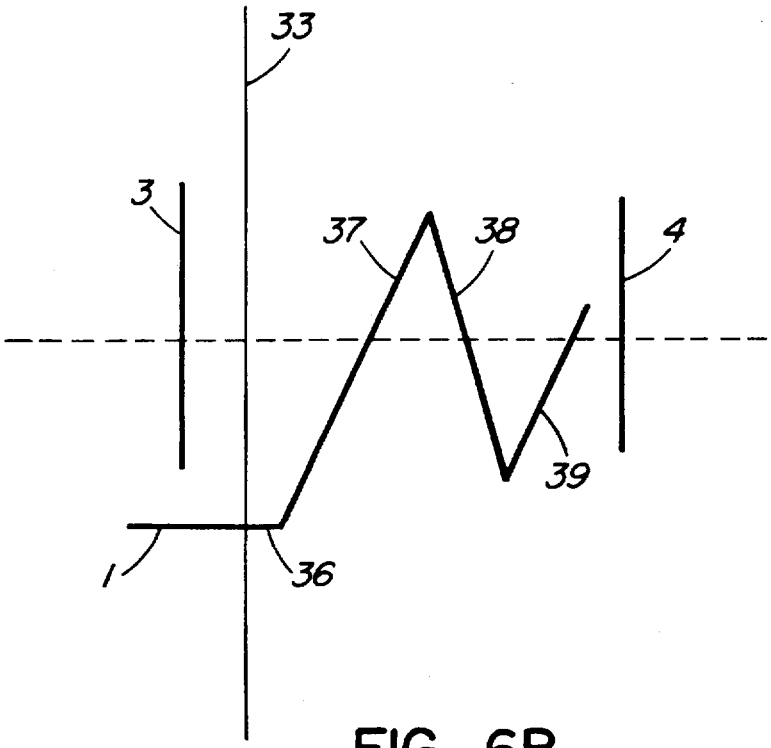

It should be appreciated that the shape or waveform of the driven element need not be rectangular but could take other suitable undulating shape, such is sinusoidal or triangular shown in FIGS. 6A and 6B, respectively. It has been found, however, that an undulation having a square waveform is easier to fabricate and is less sensitive to tolerances at corner angles.

Although dipoles are preferred, the director elements and/or the reflective element could be other microstrip elements, such as patches. The size and spacing options described with reference to the dipoles could be applied also to these other elements.

Embodiments of the present invention which employ a microstrip line feed that is coplanar with the other elements of the antenna advantageously facilitate economical manufacture and ease of integration with source/receiver circuitry as compared with antennas which use coaxial feeds through the substrate, such as that disclosed by Huang supra. Moreover, embodiments of the invention have been shown to yield higher gain, perhaps as much as 18 dBi for the embodiment of FIG. 1.

It should be appreciated that the number of directive elements could be varied. Fewer directive elements will, of course, give lower gain and broader beamwidth.

Moreover, although an undulating driven element is preferred, it is envisaged that other forms of driven element having a maximum sensitivity along the longitudinal axis, i.e. for radiation or reception in the end-fire direction of the antenna, could be substituted.

I claim:

1. An antenna unit comprising a dielectric substrate having a first surface and an opposite surface, and a microstrip antenna with a microstrip feedline provided on said first surface, the antenna comprising a driven element and a plurality of director elements, the driven element and said director elements extending in a common plane and being spaced apart from each other along a longitudinal axis of the antenna, the driven element being configured to have a maximum sensitivity substantially along said longitudinal axis and substantially in said plane, the antenna unit further comprising a ground plane provided on said opposite surface, the ground plane extending beneath the microstrip feedline but terminating before the driven element.

2. An antenna unit according to claim 1, wherein the driven element comprises a conductive strip connected at one end to said microstrip feedline and open-circuit at its opposite end and having at least one undulation about said longitudinal axis and in said plane.

3. An antenna unit according to claim 1, wherein said microstrip feedline has a plurality of sections of different widths to electrically match the impedance of the driven element to the impedance of a signal circuit to be connected to said feedline.

4. An antenna unit according to claim 1, wherein said microstrip feedline has a portion tapering from a wider section for connection to a signal circuit and a narrower end section connected to said driven element.

5. An antenna unit according to claim 2, wherein the undulation comprises at least one cycle of a rectangular alternating waveform.

6. An antenna unit according to claim 5, wherein the electrical length of the said undulation is substantially 1.43 wavelengths of an operating frequency of the antenna.

7. An antenna unit according to claim 1, wherein the driven element comprises a plurality of undulations.

8. An antenna unit according to claim 1, wherein the plurality of director elements comprises a multiplicity of conductive dipoles in a row extending away from the driven element along said longitudinal axis, each of the dipoles extending transversely to said longitudinal direction.

9. An antenna unit according to claim 8, wherein the length of each of said dipoles is substantially less than one half wavelength of the operating frequency of the antenna.

10. An antenna unit according to claim 8, wherein the dipoles are equal in length and uniformly spaced from each other.

11. An antenna unit according to claim 8, wherein the dipole lengths are progressively shorter the further dipoles arc from the drivein element.

12. An antenna unit according to claim 8, wherein the spacing between adjacent ones of said dipoles is non-uniform, increasing gradually the further dipoles are from the driven element.

13. An antenna unit according to claim 1, wherein the director elements comprise conductive rectangular patches.

14. An antenna unit according to claim 13, wherein the patches are equal in width and uniformly spaced from each other.

15. An antenna unit according to claim 13, wherein the widths of the patches are progressively less the further patches are from the driven clement.

16. An antenna unit according to claim 13, wherein the spacing between adjacent ones of said patches is non-uniform, increasing gradually the further patches are from the driven elements.

17. An antenna unit according to claim 1, wherein the undulation has a sinusoidal waveform.

18. An antenna unit according to claim 1, wherein the undulation has a triangular waveform.

19. An antenna unit according to claim 1, further comprising a conductive reflective element provided on said first surface adjacent the driven element at its side opposite from the director elements, the ground plane extending beneath said reflective element.

20. An antenna unit according to claim 19, wherein the reflective element has a width transverse to the longitudinal axis substantially larger than one half wavelength.

21. An antenna unit according to claim 19, wherein the conductive reflective element is a conductive dipole.

22. An antenna according to claim 19, wherein the conductive reflective element is a conductive rectangular patch.

23. An array of antenna units each according to claim 1, and circuitry for coupling the antenna units so as to provide for a corresponding plurality of beams, one from each antenna unit.

24. An array of antenna units each according to claim 1, and circuitry for coupling the antenna units to provide a single beam.

25. An array of antenna units each according to claim 1, the units arranged in a circle such that respective longitudinal axes of the antenna units extend radially, and circuitry for operating the antenna units to provide a plurality of switched beams together encompassing the entire circumference of said circle.

26. An array according to claim 25, wherein said circuitry is provided within the circle on a common substrate with the antenna units.

27. An array of antenna units each according to claim 1, the antenna a units arranged in a circle such that respective longitudinal axes of the antenna units extend radially, and circuitry for operating the antennas simultaneously to provide a single omni-directional beam.

28. An array according to claim 27, wherein said circuitry is provided within the circle on a common substrate with the antenna units.

* * * * *